US010161613B2

(12) United States Patent
Ladstaetter

(10) Patent No.: US 10,161,613 B2
(45) Date of Patent: Dec. 25, 2018

(54) SUPPORT RAIL FOR FORMING A LIGHTING STRIP SYSTEM AND LIGHTING STRIP SYSTEM

(71) Applicant: ZUMTOBEL LIGHTING GMBH, Dornbirn (AT)

(72) Inventor: Gerald Ladstaetter, Klaus (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 52 days.

(21) Appl. No.: 14/783,854

(22) PCT Filed: Apr. 16, 2014

(86) PCT No.: PCT/EP2014/057810

§ 371 (c)(1),
(2) Date: Oct. 10, 2015

(87) PCT Pub. No.: WO2014/173779

PCT Pub. Date: Oct. 30, 2014

(65) Prior Publication Data

US 2016/0069554 A1 Mar. 10, 2016

(30) Foreign Application Priority Data

Apr. 24, 2013 (DE) ..... 20 2013 101 777 U

(51) Int. Cl.

| | |
|---|---|
| ***F21V 21/22*** | (2006.01) |
| ***F21V 23/06*** | (2006.01) |
| ***H01R 25/14*** | (2006.01) |

(52) U.S. Cl.

CPC ..... *F21V 23/06* (2013.01); *F21V 21/22* (2013.01); *H01R 25/142* (2013.01); *H01R 25/14* (2013.01)

(58) Field of Classification Search

None

See application file for complete search history.

(56) References Cited

U.S. PATENT DOCUMENTS

| | | | |
|---|---|---|---|
| 5,404,279 | A | 4/1995 | Wood |
| 6,343,942 | B1 | 2/2002 | Okamoto |

FOREIGN PATENT DOCUMENTS

| | | |
|---|---|---|
| CN | 2242529 | 12/1996 |
| CN | 1252365 | 5/2000 |
| DE | 29917693 | 4/2000 |
| DE | 10025646 | 11/2001 |
| DE | 2020100008431 | 12/2011 |
| EP | 1830121 | 9/2007 |
| EP | 2151899 | 2/2010 |

(Continued)

OTHER PUBLICATIONS

English translation of EP2151899A2, Publication date Feb. 10, 2010.*

(Continued)

*Primary Examiner* — Britt D Hanley

(74) *Attorney, Agent, or Firm* — Brooks Kushman P.C.

(57) ABSTRACT

A support rail for holding and supplying power to illumination modules has a wiring unit with coupling elements for electrically connecting at least two illumination modules, wherein the wiring unit is divided into two sub-units which each have at least one coupling element, and wherein the sub-units can be adjusted relative to each other in the longitudinal direction of the support rail.

6 Claims, 4 Drawing Sheets

(56) References Cited

FOREIGN PATENT DOCUMENTS

| | | |
|---|---|---|
| WO | 9424731 | 10/1994 |
| WO | 0191249 | 11/2001 |
| WO | 2012109683 | 8/2012 |

OTHER PUBLICATIONS

International Search Report for PCT/EP2014/057810, English translation attached to original, Both completed by the European Patent Office dated Jun. 27, 2014, All together 7 pages.
Chinese Search Report for Chinese Application No. CN 2014800219604, Completed by the Chinese Patent Office dated Jan. 23, 2017, 1 Pages.

* cited by examiner 50
50
60
2₁
2₂
20₁
20₂
M₁
M₂
M₃
9
50
50
60
60

SUPPORT RAIL FOR FORMING A LIGHTING STRIP SYSTEM AND LIGHTING STRIP SYSTEM

CROSS-REFERENCE TO RELATED APPLICATION

This application is the U.S. national phase of PCT Application No. PCT/EP2014/057810 filed on Apr. 16, 2014, which claims priority to DE Patent Application No. 20 2013 101 777.9 filed on Apr. 24, 2013, the disclosures of which are incorporated in their entirety by reference herein.

The present invention relates to a support rail for retaining, and supplying power to, light-fitting modules, the support rail being provided to form a lighting-strip system. The invention also relates to a corresponding lighting-strip system having such a support rail.

A known lighting-strip system is described, for example, in WO 01/91249 A1. Said system comprises a plurality of support rails which are arranged one behind the other in a longitudinal direction and serve for retaining, and supplying power to, a plurality of light-fitting units or light-fitting modules. A so-called current-conducting profile extends in the longitudinal direction along the support rails, and the light-fitting modules can be connected electrically to said profile, the modules also being fastened, at the same time, mechanically on the support rail. For operation, the customary mains voltage of typically 230V is applied to the current-conducting profile. Each light-fitting module has lamps and a corresponding operating unit for converting the mains voltage to an operating voltage suitable for operating the relevant light source. By virtue of support rails with associated light-fitting modules being correspondingly lined up in a row one beside the other, it is then possible to realize lighting strips which extend over a relatively long length.

As an alternative to the embodiment described above, it is also known for sheathed power-supply lines to be laid within the support rails, wherein coupling elements with the electrical connection of a light-fitting module are provided merely at certain predetermined locations. Since the light-fitting modules are usually of standard length, it is sufficient if connection is made possible merely at these certain positions.

A disadvantage of the known solutions, however, is that the usually predetermined standard length of the light-fitting modules, for adaptation of the length of the lighting-strip system as a whole, results in certain limitations. If the intention is to achieve continuous emission of light over the entire length, then the lighting-strip system can have only an overall length which corresponds to a whole-numbered multiple of the length of the light-fitting modules. More flexible length adaptations, in contrast, are not possible, this being problematic insofar as there are increasing demands for it to be possible for the length of a lighting-strip system to be adapted precisely to the length of a room in which the lighting-strip system is being used. If it is the intention, for example with the aid of the lighting-strip system, to achieve a line of lighting along a passageway which is to be illuminated, then it is desirable for this line of lighting to extend precisely from one end of the passageway to the other. This is not possible, in some circumstances, in the case of the known lighting-strip systems.

It is therefore an object of the present invention to provide a novel solution for realizing support rails with the aid of which a lighting-strip system can be formed, the support rails allowing length adaptation which is as flexible as possible.

The object is achieved by a support rail for retaining, and supplying power to, light-fitting modules having the features of claim 1. Advantageous developments of the invention form the subject matter of the dependent claims.

The concept of the invention is based on the above-described variant in which coupling elements for the electrical connection of light-fitting modules are provided at certain locations. Said coupling elements are arranged on a so-called wiring unit, wherein, in the prior art, as mentioned, the coupling elements were then arranged at predetermined spacings apart from one another. In order, then, to create a greater level of flexibility in respect of length adaptation, the invention provides for the wiring unit to be subdivided into two sub-units each having at least one coupling element for the electrical connection of a light-fitting module, wherein the sub-units can be adjusted relative to one another in the longitudinal direction of the support rail. Since the two sub-units, and thus the coupling elements located thereon, can be displaced relative to one another, it is possible, then, to change the site of connection for the corresponding light-fitting modules. This means that there is no longer any limitation to light-fitting modules of a predetermined standard length; rather, it is also possible, instead, to make use of one or more shorter light-fitting modules in order then, together with all the other light-fitting modules, to realize the lighting-strip system in the desired overall length.

The invention therefore proposes a support rail for retaining, and supplying power to, light-fitting modules, having a wiring unit with coupling elements with the electrical connection of at least two light-fitting modules, wherein the wiring unit is subdivided into two sub-units each having at least one coupling element, and wherein the sub-units can be adjusted relative to one another in the longitudinal direction of the support rail.

The light-fitting modules connected to the sub-units should be supplied preferably via a common power-supply circuit. Accordingly, provision is made here for a corresponding common circuit to be realized, the sub-units then being connected electrically via a flexible cable. It is possible here in particular for the circuit for supplying power to the connected light-fitting modules to be connected, on the input side, to an operating unit or a converter that, on the one hand, is connected to a power-supply connection for the support rail and, on the other hand, provides the circuit with a voltage which is necessary for operating the light-fitting modules. This variant is advantageous insofar as, by virtue of the fact that it is now the case that the support rail provides the operating unit and therefore, right from the outset, a suitable current, it is possible to dispense with corresponding units on the light-fitting modules themselves. Since such converters usually have a certain minimum length, it has also been necessary, up until now, for the light-fitting modules to be of correspondingly long design, which, in turn, constitutes a limitation in respect of precise length adaptation. Since it is now the case, however, that it is possible to dispense with the operating units directly on the light-fitting modules, it is also possible, in particular if the light sources used are LEDs, to realize very short light-fitting modules, and this, of course, allows considerably better adaptation of the overall length of the lighting-strip system.

Advantageously, provision may also be made for the two sub-units each to have a plurality of coupling elements, wherein then the spacings between adjacent coupling elements of a first sub-unit are larger than the corresponding spacings of a second sub-unit. The aforementioned converter is then arranged on one of the two sub-units, preferably on the first sub-unit.

The sub-units of the support rail according to the invention, said sub-units being responsible for power supply, are preferably arranged within an elongate, in particular U-shaped carrier element. The accommodating space in the carrier element then serves predominantly for storing the electric lines and the sub-units with the coupling elements. Corresponding mating coupling parts of the light-fitting modules then engage, during connection to the support rail, in said interior or the light-fitting modules are even placed in their entirety in said interior. On this side of the support rail or the carrier element, it is then possible to arrange a covering which extends possibly over a plurality of support rails, or even over the entire lighting-strip system, via which uniform, homogeneous emission of light takes place.

Of course, for flexible length adaptation of the lighting-strip system, it is then also necessary for the corresponding carrier element to be adapted in length. It is possible here, on the one hand, for the carrier element to extend in one piece over the entire length of the support rail, wherein then at least one of the two sub-units is arranged in a displaceable manner in the carrier element. Following appropriate positioning of this adjustable sub-unit, the carrier element then has to be adapted, if appropriate, correspondingly, although this can take place by straightforward cutting to length. In an alternative embodiment, on the other hand, provision may be made for each sub-unit to be assigned a dedicated support-rail segment, wherein the two support-rail segments can be pushed telescopically one inside the other. All that is then actually required here is for the two support-rail segments with the associated sub-units to be pushed one inside the other in order to achieve length adaptation; no further operations are necessary. However, since it is the case here that the transition between the two support-rail segments is then evident on the outside of the support rail, such a variant is suitable predominantly for the case where the lighting-strip system is utilized as an installation variant. In the case of an add-on variant, in contrast, or in the case of the lighting strip being suspended, use is preferably made of the first-mentioned variant.

To conclude, therefore, the solution according to the invention helps to make it possible for lighting-strip systems to be adapted in an extremely flexible, but very precise, manner to desired lengths.

The invention will be explained in more detail hereinbelow with reference to the accompanying drawing, in which.

Figure 1:
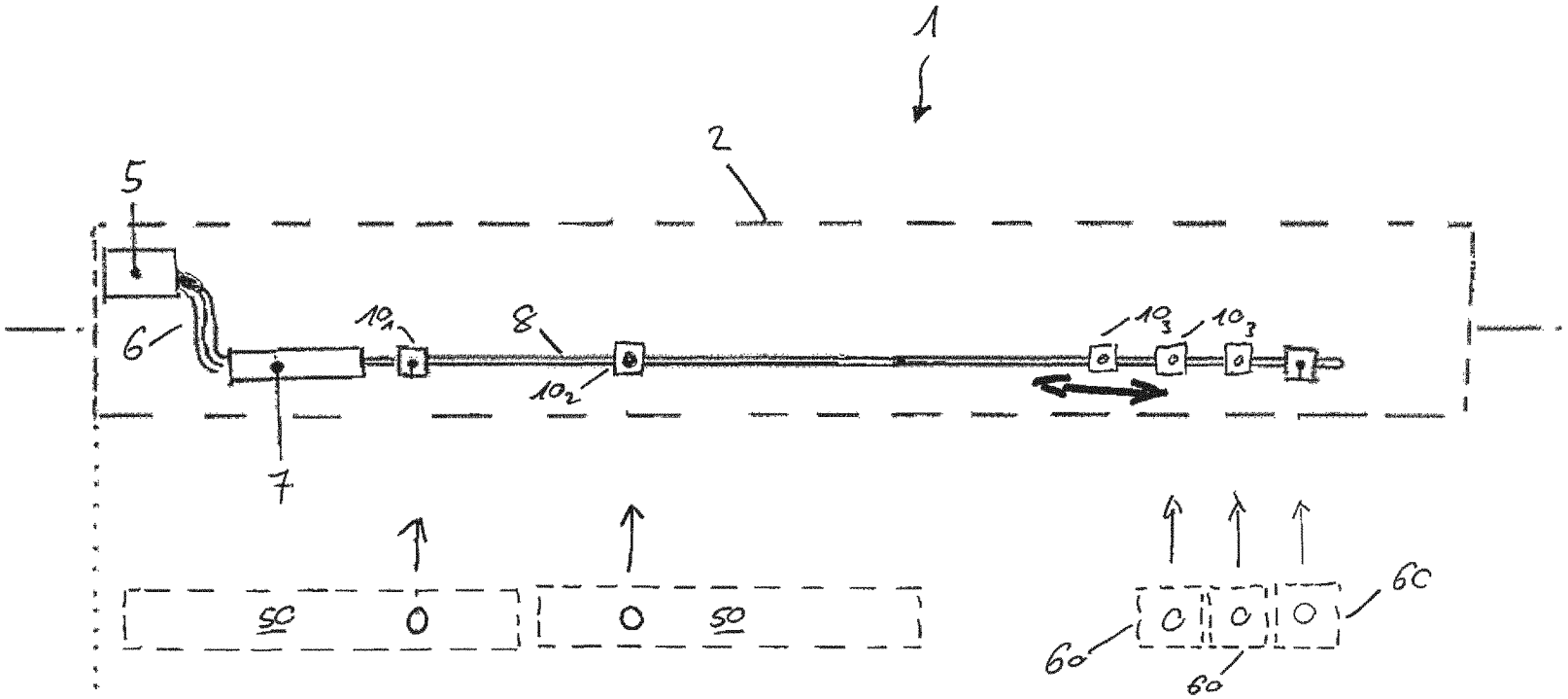
FIG. 1 shows the basic construction of a support rail according to the invention.

FIG. 1 shows a highly schematic sketch of an exemplary embodiment of a support rail according to the invention, in this case provided in general terms with the reference sign 1. The support rail 1 is of overall elongate design and extends along the lighting-strip system which is to be realized, wherein it is designed at least one end region, in this case the left-hand end region, for connection to an adjacent support rail. It should be noted here that the adjacent support rail need not necessarily be identical to the support rail according to the invention illustrated in FIG. 1, since, for adaptation of the overall length of the lighting-strip system, it is sufficient if a single support rail, preferably one located at one end, is of variable configuration. Since the solution according to the invention is inevitably somewhat more complex than a support rail of fixed length, support rails of fixed length are preferably used throughout the rest of the system.

The various components of the support rail 1 are arranged, and the support rail 1 is installed for example on the ceiling, or in the ceiling, of a room, via an elongate element 2, which is preferably formed by a U-shaped carrier part. This then forms an elongate accommodating space, in which are arranged the components of the support rail 1, which are described hereinbelow, and possibly also then the light-fitting modules, which can be connected thereto. The underside of the carrier element 2 is closed by a transparent light-emission covering, said covering then, depending on the emission of light desired, having appropriate optical properties. On the end side, the carrier element 2 is designed such that it can be coupled, at least at one end, to carrier elements of adjacent support rails.

In order to supply power to the light-fitting modules which are to be connected, a corresponding electric coupling element 5 is provided on the end side. The latter is connected to the through-wiring, which extends along the lighting-strip system, and is thus connected to the power supply in general. In the case of the support rail 1 being coupled at either end to adjacent support rails, said through-wiring would then also be routed through the carrier element 2, in which case it would then be necessary to provide, at the opposite end, a further coupling element for electrical connection to a further adjacent support rail. In the case of an arrangement at the end region of the lighting strip, in contrast, this is not necessary.

In the case of the embodiment illustrated, provision is preferably made for the light-fitting modules which are to be connected not to be connected directly to the mains-supply voltage of approximately 230V. This would require the modules themselves to have dedicated operating units, for example converters or transformers, but this would lead to certain minimum overall sizes for the light-fitting modules. In the case of the variant illustrated, provision is therefore made for the lines of the general power supply to have connected to them a converter 7 which is utilized in the center of the support rail 1 and is connected, on the output side, to the circuit 8 for supplying power to the light-fitting modules. This converter 7 therefore makes available, to the circuit 8, the supply voltage which is suitable for operating the light sources of the light-fitting modules. This may be, for example, a d.c. voltage suitable for LED operation, if the use of LED-based light-fitting modules is envisaged. For the connection of the light-fitting modules, a plurality of coupling elements 10 are then provided on the circuit 8, said coupling elements being coupled to corresponding mating coupling elements of the light-fitting modules.

In the case of the support rail 1 being of fixed length, the coupling elements 10 would be at predetermined standard spacings in relation to one another, allowing light-fitting modules of corresponding standard length to be connected. In this case, the overall length of the support rail 1 then corresponds to the corresponding whole-numbered multiple of the standard light-fitting modules. According to the present invention, however, provision is now made, in the case of the variable-length support rail, for the position of at least some coupling elements to be variable. It is illustrated in purely schematic form FIG. 1 that the first two coupling elements $\mathbf{10}_1$ and $\mathbf{10}_2$ cannot be changed in position, the positions being selected such that corresponding light-fitting modules of standard length 50 can be connected, as is indicated in FIG. 1. The subsequently illustrated coupling elements $\mathbf{10}_3$, in contrast, are at a considerably shorter spacing apart from one another in the first instance. Furthermore, they can be adjusted relative to the first two coupling elements $\mathbf{10}_1$ and $\mathbf{10}_2$ in a manner corresponding to the double arrow indicated. Depending on the corresponding adjustment and on the adaptation of the carrier element 2—said adaptation will be described in more detail hereinbelow—the result is a leftover residual length, which can be utilized, and filled, by one or more light-fitting modules 60. These are considerably shorter light-fitting modules which then, in their entirety, fill the residual length so that, as seen overall, all the modules extend continuously over the variably selected length of the support rail 1.

Figure 2:
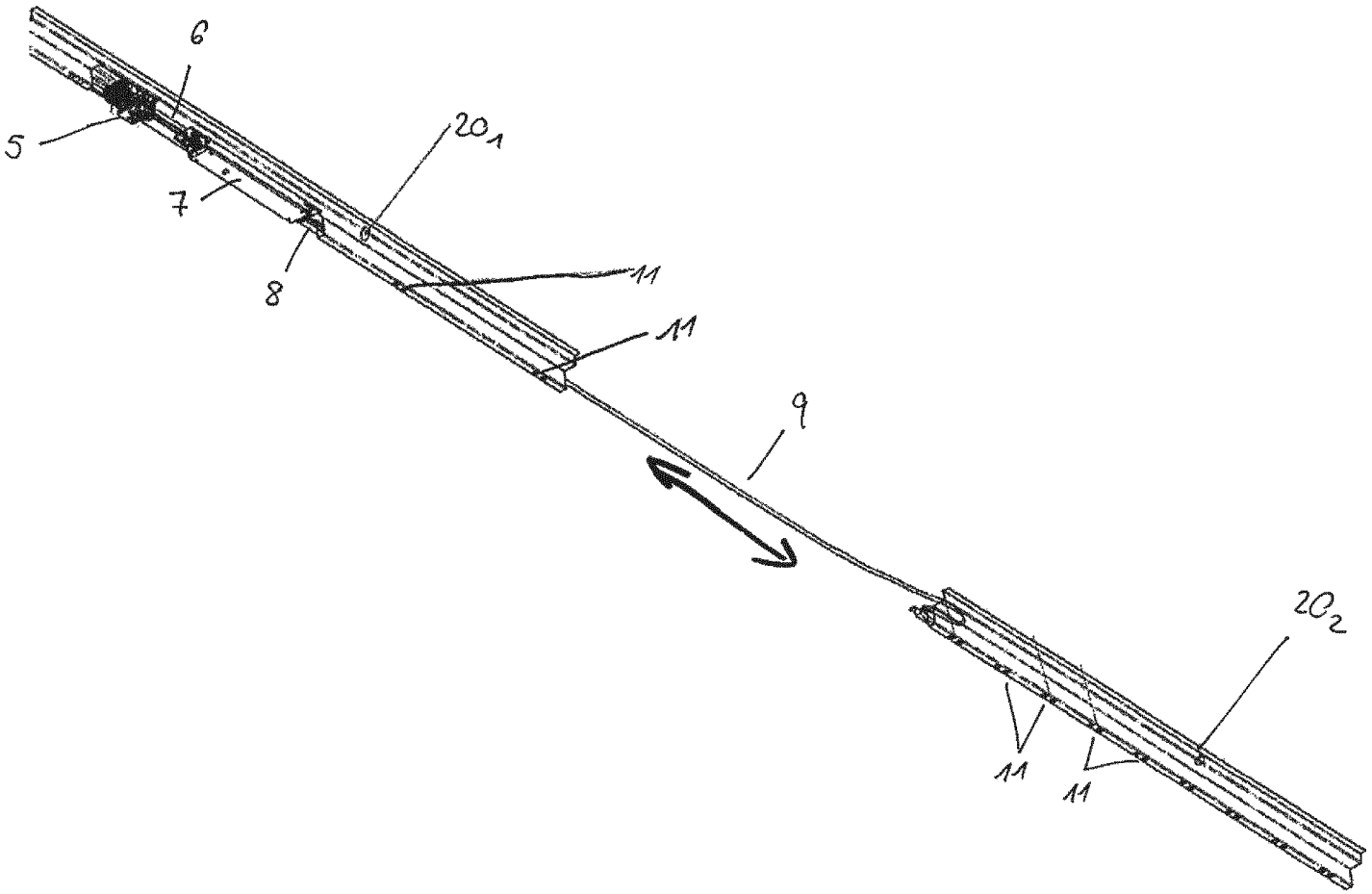
FIG. 2 shows the illustration of the wiring sub-units which are used in the support rail according to the invention and can be adjusted in relation to one another.

A possible way of realizing the concept of a variable arrangement of the coupling elements which is illustrated schematically by way of FIG. 1 is shown in FIG. 2. This figure has dispensed with the illustration of the carrier element 2 of the support rail 1; rather, it has illustrated merely the so-called wiring units $\mathbf{20}_1$ and $\mathbf{20}_2$, which are arranged in the support rail and form the connection means for the light-fitting modules. For example, two corresponding bushings 11, which contain the coupling elements are evident on the underside of the wiring unit $\mathbf{20}_1$. In the case of the second wiring unit $\mathbf{20}_2$, on the other hand, considerably more bushings 11 are provided, and these are also at a considerably smaller spacing apart from one another. FIG. 2 also shows the converter 7, which is arranged on the first wiring unit $\mathbf{20}_1$ and is connected, via the lines 6, to the corresponding coupling element for connection to the general power supply. The lines 8 of the supply circuit for the light-fitting modules then extend from said converter 7 on the output side, the coupling elements 10 then being arranged on the corresponding bushings 11. The supply circuit here also extends through the second sub-unit $\mathbf{20}_2$, wherein the first sub-unit $\mathbf{20}_1$ and second sub-unit $\mathbf{20}_2$ are connected via a flexible cable 9.

In the case of a support rail of fixed length, a wiring unit would extend in one piece over the entire length of the support rail 1. According to the invention, however, provision is now made as illustrated for the wiring unit to be subdivided into the two sub-units $\mathbf{20}_1$ and $\mathbf{20}_2$ each having one or more coupling elements, or corresponding bushings 11, for the connection of the light-fitting modules, it being possible for the wiring units $\mathbf{20}_1$ and $\mathbf{20}_2$ to be adjusted relative to one another. Since the electrical connection takes place by way of the flexible cable 9, the spacing between the two sub-units $\mathbf{20}_1$ and $\mathbf{20}_2$ can be selected freely between a maximum distance, which corresponds to the length of the cable 9, and a minimum distance, where the wiring units $\mathbf{20}_1$ and $\mathbf{20}_2$ butt against one another by their end sides.

The two wiring units $\mathbf{20}_1$ and $\mathbf{20}_2$ can be adjusted relative to one another in various ways. In the case of a first variant, provision is made for the outer support rail, not illustrated in FIG. 2, that is to say the U-shaped carrier element 2, to extend in one piece over the entire length. In this case, provision is preferably made for one of the two sub-units, in particular the first sub-unit $\mathbf{20}_1$ with the converter 7, to be fixed at the corresponding end region of the carrier element 2. Within the carrier element 2, the second sub-unit $\mathbf{20}_2$ can be arranged in the variable manner, or displaced in the longitudinal direction, in the previously described range. That end of the second sub-unit $\mathbf{20}_2$ which is directed away from the first sub-unit $\mathbf{20}_1$ then defines the end region of the possible contacting means and then also corresponds to the end of the support rail which is to be realized, which means that possibly the carrier element 2 has to be cut off at the corresponding location. However, since the operation of cutting the carrier element 2 to length is a purely mechanical one, and in particular there are no electric lines or the like adversely affected thereby, said operation constitutes straightforward mechanical measures which can be carried out without any great amounts of effort or expense being required. However, this advantageously achieves the situation where the carrier element then extends in one piece over the entire length of the support rail, which is esthetically advantageous in comparison with the variant described hereinbelow.

Figure 3:
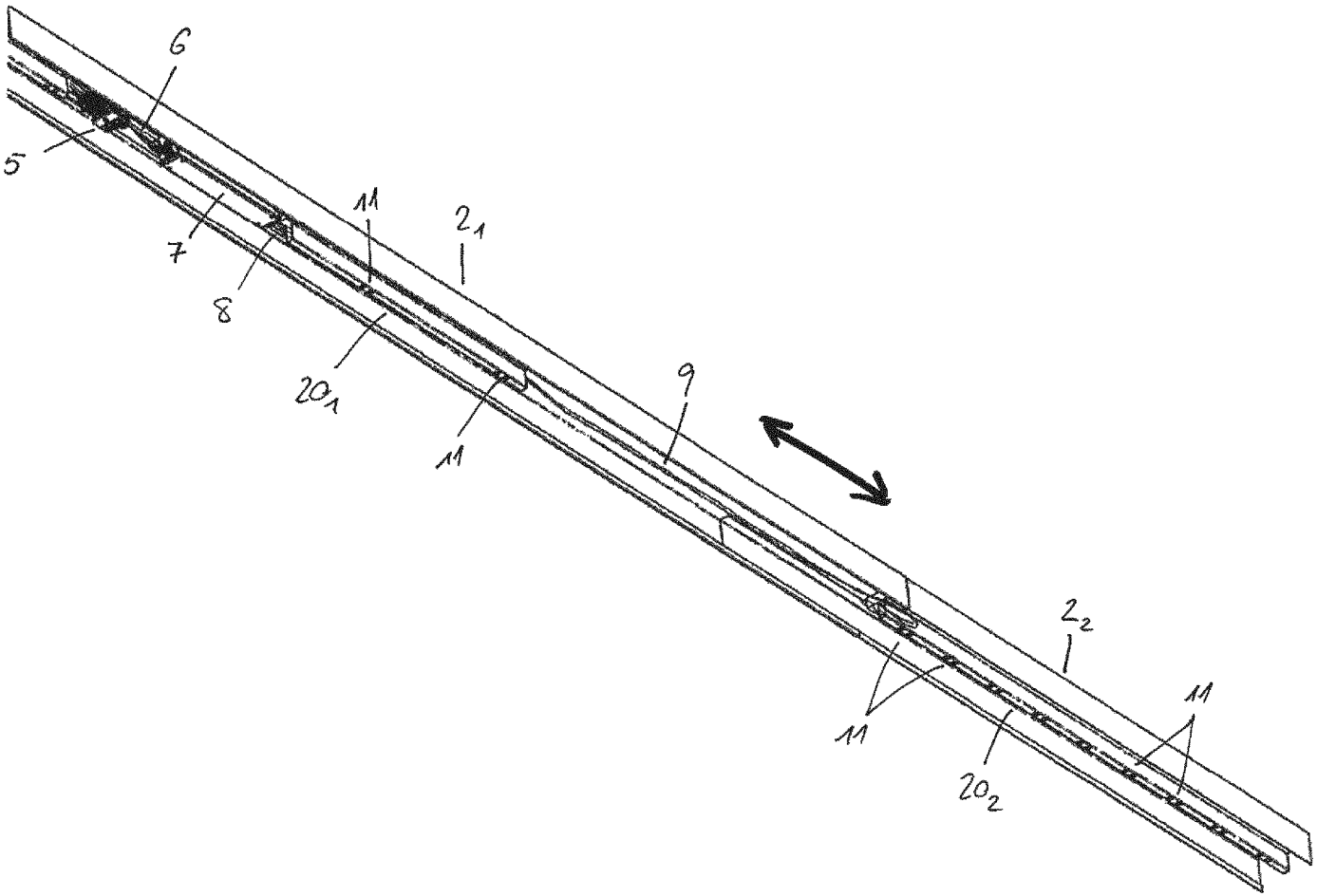
FIG. 3 shows a variant of the support rail according to the invention in which support-rail segments with the corresponding sub-units can be pushed telescopically one inside the other.

This is because, in the case of a second variant, illustrated in FIG. 3, the carrier element 2 itself is formed by two support-rail segments $\mathbf{2}_1$ and $\mathbf{2}_2$, the corresponding sub-units $\mathbf{20}_1$ and $\mathbf{20}_2$ now being fixed in each of these support-rail segments. However—as illustrated—the two support-rail segments $\mathbf{2}_1$ and $\mathbf{2}_2$ engage telescopically one inside the other and can, in turn, be displaced relative to one another, in a manner corresponding to the double arrow illustrated, in order for the positioning of the sub-units $\mathbf{20}_1$ and $\mathbf{20}_2$ with the contact bushings 11 to be adjusted in a desired manner. The telescopic inter-engagement of the support-rail segments $\mathbf{2}_1$ and $\mathbf{2}_2$ means that the carrier element 2 is then also automatically adapted in length correspondingly, no further measures being necessary here. However, a slight stepped formation is evident at the transition region between the two segments, as is also shown in FIG. 3. This may possibly be undesirable, for esthetic reasons, in particular when the support rail 1 is utilized as an add-on variant or in suspended form. In this case, the variant according to FIG. 2 is then preferred. For the case, on the other hand, where the support rail 1 is to be installed in the installation opening of a ceiling, the outside of the carrier element 2 is not evident anyway, and therefore, in this case, such visual concerns play no part.

Figures 4A, 4B:
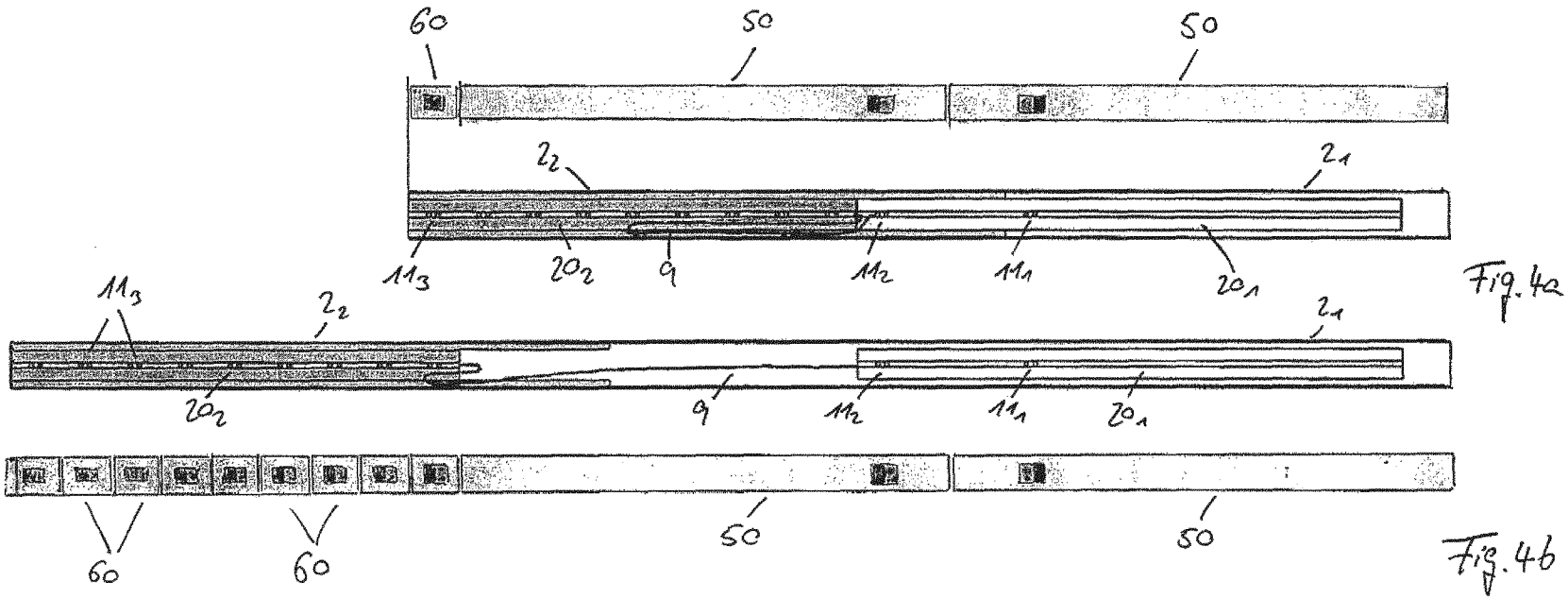
FIGS. 4*a* and 4*b* show illustrations to clarify the level of flexibility for configuring the length of the support rail according to the invention.

FIGS. 4*a* and 4*b* will be used to give a further, brief, explanation of the advantage of the solution according to the invention, wherein the support rail 1 according to the invention is illustrated in two different lengths, together with the light-fitting modules 50, 60 which are to be connected thereto, the corresponding contacts also being illustrated in each case for the light-fitting modules. In the case of a short variant, as is illustrated in FIG. 4*a*, for example in the first instance the two bushings $\mathbf{11}_1$ and $\mathbf{11}_2$ are occupied by light-fitting modules 50 of a standard length, wherein as is evident the left-hand light-fitting module 50 has been rotated through 180°. The two modules utilize the bushings $\mathbf{11}_1$ and $\mathbf{11}_2$, which are fixed on the first sub-unit. In contrast, the second sub-unit with the bushings $\mathbf{11}_3$, which are positioned at considerably shorter spacings apart, is positioned, in the example illustrated, in the vicinity of the first sub-unit $\mathbf{20}_1$, and therefore there is only a very small spacing present here. The remaining length of the support rail 1 is then occupied by a shorter light-fitting module 60, which can be coupled to the appropriate bushing $\mathbf{11}_3$.

In the case of the variant according to FIG. 4*b*, in contrast, the second sub-unit $\mathbf{20}_2$ is drawn to the maximum length. Once again, in the first instance the first two bushings $\mathbf{11}_1$ and $\mathbf{11}_2$ of the first sub-unit $\mathbf{20}_1$ are occupied by standard light-fitting modules 50. The leftover residual length of the support rail 1 is then occupied by the short light-fitting module 60, which all utilize corresponding bushings $\mathbf{11}_3$ of the second sub-unit $\mathbf{20}_2$. It is clear that, in the case of the second sub-unit $\mathbf{20}_2$ being in corresponding intermediate positions, then use is made of a correspondingly smaller number of shorter modules 60, although length adaptation of the support rail can now be achieved, overall, in very small steps.

Overall, therefore, the solution according to the invention helps to make it possible for the length of a support rail to be adapted extremely conveniently to a desired final length. As already mentioned, it is sufficient if, in such a lighting-strip system, there is only a single support rail which is correspondingly variable in length. The rest of the support rails, in contrast, may, in the usual way, be of standard lengths.

It should also be noted that it would also be conceivable, in theory, for all the light-fitting modules to have a dedicated converter and, accordingly, for the circuit for supplying power to the light-fitting modules to be coupled directly to the general power supply. However, since using the converter in the center of the support rail itself can result in reductions in the length of the light-fitting modules, the embodiment illustrated makes it possible to realize considerably shorter light-fitting modules, which ultimately allows better length adaptation of the support rail overall.

The invention claimed is:

1. A lighting-strip system having a support rail for retaining, and supplying power to, at least two light-fitting modules, each light-fitting module comprising:

a wiring unit with coupling elements for an electrical connection with at least two light-fitting modules, wherein the wiring unit is subdivided into two sub-units each having at least one coupling element, and wherein the sub-units can be adjusted relative to one another in a longitudinal direction of the support rail;

wherein the two sub-units have a common circuit for supplying power to the connected light-fitting modules, wherein the sub-units are connected electrically via a flexible cable; and wherein the circuit for supplying power to the connected light-fitting modules, has on an input side, a converter, which is connected to a power-supply connection for the support rail.

2. The lighting-strip system as claimed in claim 1, wherein the support rail has two sub-units each have a plurality of coupling elements, wherein spacings between adjacent coupling elements of a first sub-unit are larger than the corresponding spacings in a second sub-unit.

3. The lighting-strip system as claimed in claim 1, wherein the converter is arranged on one of the two sub-units, preferably on a first sub-unit.

4. The lighting-strip system as claimed in claim 1, wherein the sub-units are arranged within the support rail which is formed by an elongate U-shaped carrier element.

5. The lighting-strip system as claimed in claim 4, wherein the carrier element extends in one piece over an entire length of the support rail, wherein at least one of the two sub-units is arranged in a displaceable manner in the carrier element.

6. The lighting-strip system as claimed in claim 4, wherein each sub-unit is assigned a support-rail segment, wherein the support-rail segments can be pushed telescopically one inside the other.

* * * * *